United States Patent [19]

Musil

[11] Patent Number: 4,734,028

[45] Date of Patent: Mar. 29, 1988

[54] ADAPTER FOR CONVERTING AN OIL BURNER HEAD FOR BURNING OF PULVERIZED COAL

[75] Inventor: Joseph E. Musil, Ely, Iowa

[73] Assignee: Cedarapids, Inc., Cedar Rapids, Iowa

[21] Appl. No.: 909,881

[22] Filed: Sep. 22, 1986

[51] Int. Cl.[4] ..... F23C 5/28

[52] U.S. Cl. ..... 431/175; 431/174; 431/182; 431/284; 110/261; 110/262; 239/402.5; 239/404

[58] Field of Search ..... 431/174, 175, 177, 182–187, 431/284; 239/402.5, 403, 404, 406; 110/264, 261, 262, 263

[56] References Cited

U.S. PATENT DOCUMENTS

| | | | |
|---|---|---|---|
| 2,335,188 | 11/1943 | Kennedy | 431/284 |
| 2,366,463 | 1/1945 | Vroom et al. | 431/284 |
| 4,422,389 | 12/1983 | Schroder | 431/284 |
| 4,600,377 | 7/1986 | Musil | 239/402.5 |

*Primary Examiner*—Carroll B. Dority, Jr.

*Attorney, Agent, or Firm*—Simmons, Perrine, Albright & Ellwood

[57] ABSTRACT

An adapter to permit an oil burner head to burn pulverized coal alone or in combination with other fuels features a manifold in the form of a mirrored pair of scrolls forming a part of the burner head. The interiors of the scrolls are divided into separate coal and air passages which open into the primary air passage of the burner head through outlets uniformly circularly disposed thereabout.

12 Claims, 4 Drawing Figures

ADAPTER FOR CONVERTING AN OIL BURNER HEAD FOR BURNING OF PULVERIZED COAL

BACKGROUND OF THE INVENTION

Oil burner heads adapted to burn gaseous fuels instead of oil are well known. The adaptation is usually performed by a manifold which envelopes the burner head and introduces the gas into the air flow through the burner well upstream of the oil nozzle. The manifold is simply left in place when burning oil. Oil burner heads have also been adapted to burn pulverized coal either alone or in combination with oil and /or gaseous fuel but, so far as is known, a separate "coal head", as it were, has been employed for that purpose simply mounted at the downstream end of the oil head. Essentially such coal heads are a scroll or a scroll mounted about a short tube, a mixture of pulverized coal and a portion of the primary air being blown into the scroll. The mixture enters the combined air streams emitted from the oil head through a circle of ports fed from the scroll. Several disadvantages ensure from that arrangement.

First, since owing to its radiant heat properties a refractory ignition port or tuyere most always must be used downstream of the burner, oil burner heads adapted to burn coal are most always of the refractory type. Hence the tuyere and burner head itself must be relocated to allow insertion of the coal head. Second, combustion of the coal is rather uneven and inefficient because most of the coal tends to collect at the far end of the scroll and so enters the burner's air stream through the port or two at that end of the scroll rather than from the scroll uniformly through all the ports into the burner's air stream. That results in most of the coal impinging upon the combined air streams in a more or less single transverse direction rather than in a multitude of such directions all converging at the center of the air stream. Third, the fact that the coal joins the combined primary and secondary air streams also results in less efficient mixing of the coal and air and thus less efficient combustion than if the coal were first thoroughly mixed in the primary air stream, as in the case of oil, before being combined with the secondary air.

Thus the primary object of the present invention is an adapter which allows conversion of an oil burner head to pulverize coal but obviates the disadvantages mentioned.

SUMMARY OF THE INVENTION

Instead of a separate "coal head" attached to the downstream end of the oil head, the invention provides an adapter which is incorporated into the oil head itself and which can be left in place when burning oil. The adapter, in the installation later described in detail, is an integral part of the exterior nose of the oil head and feeds the pulverized coal and air into the primary air stream. Essentially the adapter is a manifold, preferably in the form of a pair of mirrored scrolls, which spacedly surrounds the primary air passage of the burner head. The interior of each scroll is divided into separate coal and air passages downstream of a common scroll inlet, the outlets from all the passages being uniformly disposed in a circle around the primary air passage. Preferably the outlets from the scrolls empty into a venturi just downstream of its throat, the venturi being a typical part of the primary air passage of many oil burners and into which fuel is sprayed by a nozzle when the head is operating on oil.

Consequently it is no longer necessary to relocate the burner is order to operate on coal, nor need the adapter of the invention be removed in order to return to oil firing. Furthermore, since the coal and air are separated into discrete passages in the two scrolls, the same are injected much more uniformly into and around the primary air passage. And better mixing of the coal and primary air is achieved since the coal enters in substantially the same area as does oil and so receives the same beneficial mixing with primary air for better and more efficient combustion when the coal later joins the secondary air downstream in the tuyere and is ignited. Other features and advantages of the invention will be apparent from the drawings and the more detailed description which follows.

DETAILED DESCRIPTION OF THE PREFERRED EMBODIMENT

Figure 1:
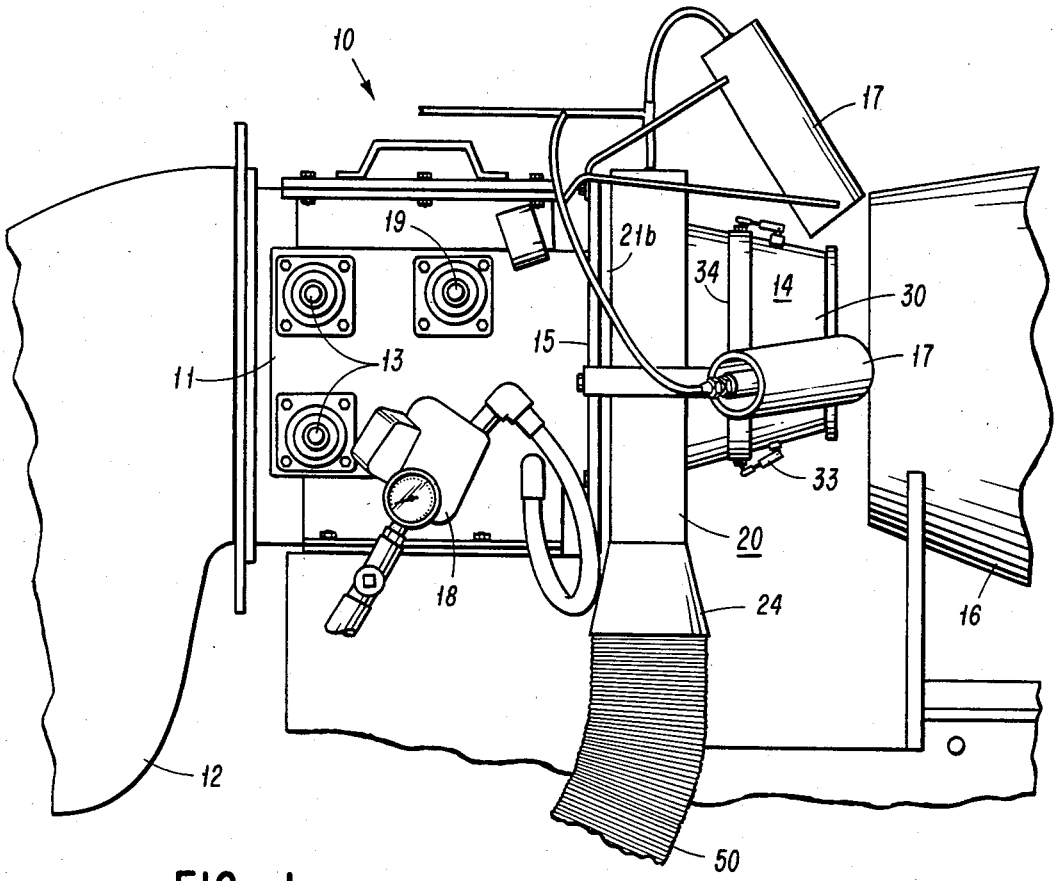
FIG. 1 is a side elevation of a typical oil burner with the adapter of the invention incorporated into the burner head.

In FIG. 1 the overall burner 10 includes a generally cylindrical housing 11 whose upstream end is supplied with air from a blower 12, the quantity of air when operating on gaseous fuel or LP gas being adjusted by internal dampers controlled by transverse shafts 13. The burner head, generally designated at 14, is bolted to a flange 15 on the forward end of the housing 11 and discharges into a refractory ignition port or tuyere 16 in which combustion occurs after ignition by igniters 17.

The particular oil burner head 14 incorporating the adapter of the invention is a modified version of a well-known prior art type. Essentially that consists of a primary air assembly spacedly surrounded by a housing having a frusto-conical nose. Air is introduced into the primary air assembly through a "swrler" and thence through a venturi into which the oil from a metering valve 18 is sprayed. Secondary air is supplied through the annular space between the housing and the primary air assembly and is metered between the downstream end of the primary air assembly and the housing nose. As firing rate increases the primary air assembly axially retreats in order to meter an increased amount of secondary air, the primary air assembly being supported for that purpose on several guide blocks secured to the housing in and about the annular secondary air passage. Movement of the primary air assembly is accomplished through an internal linkage operated by a transverse shaft 19. When modified to accept the coal adapter of the invention the housing of the oil head is removed and replaced with the adapter which will now be described in conjunction with FIGS. 2 and 3.

Figure 3:
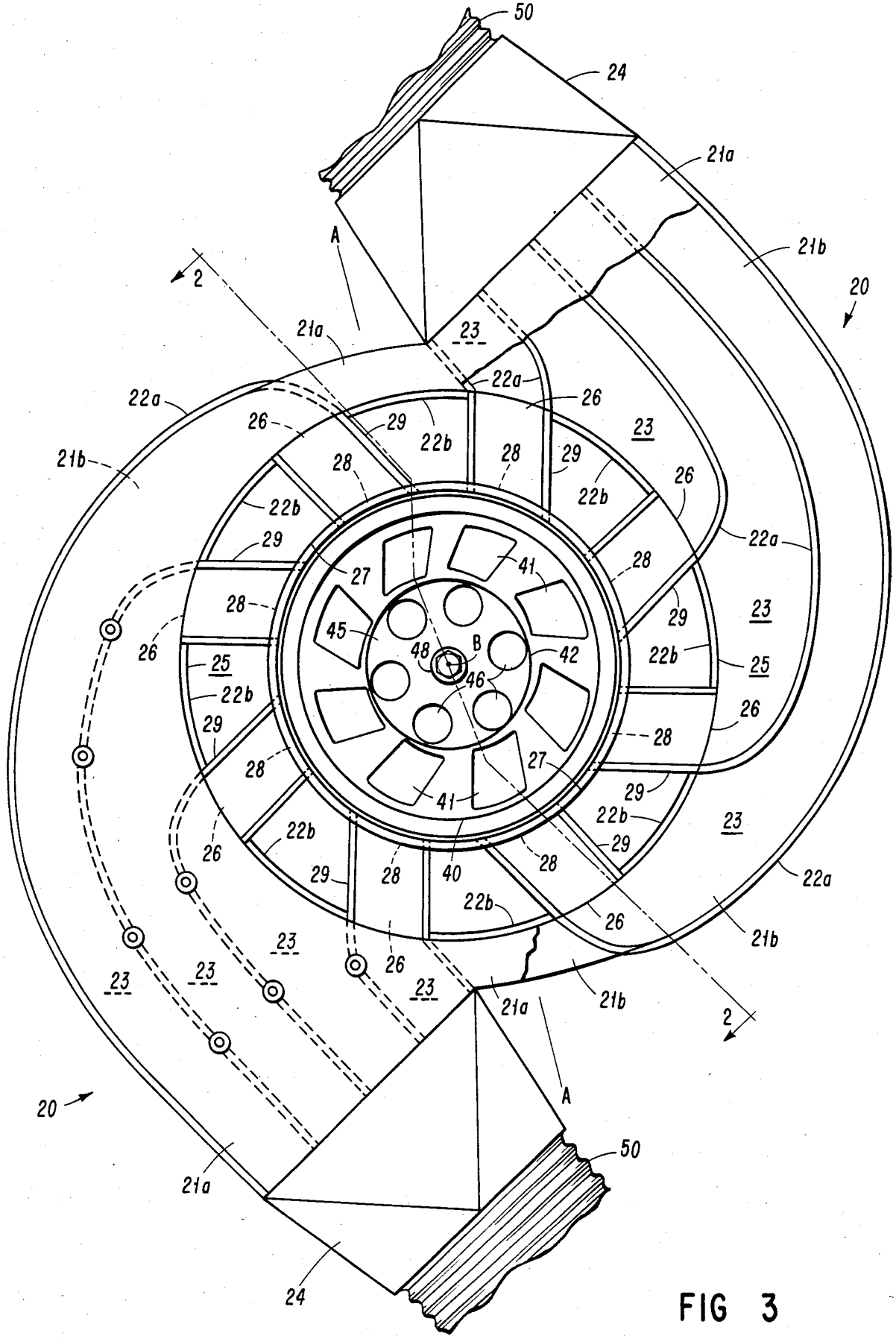
FIG. 3 is a sectional view taken along the line 3—3 of FIG. 2.

The adapter is in effect an integral structure welded up from individually fashioned plate components and, as previously mentioned, is basically a manifold consisting of a pair of mirrored scrolls 20 symmetrically disposed on each side of a plane A—A through a central axis B, as shown in FIG. 3. Each scroll 20 includes a pair of spaced flat side plates 21*a* and 21*b* separated by exterior and interior curvilinear wall plates 22*a* and 22*b* of varying lengths in order to divide the interior of each scroll 20 into a number of discrete interior coal and air passages 23. The upstream ends of the passages 23 of each scroll 20 are provided with a common inlet fitting 24, the fittings 24 thus opening in opposite directions with respect to the axis B. The inner ends of the passages 23 open between the scroll wall plates 22*b*, which in effect form a composite annular member 25 upon which the scrolls 20 are mounted, so that an array of scroll outlets 26 are provided uniformly circularly disposed about the axis B.

Figure 2:
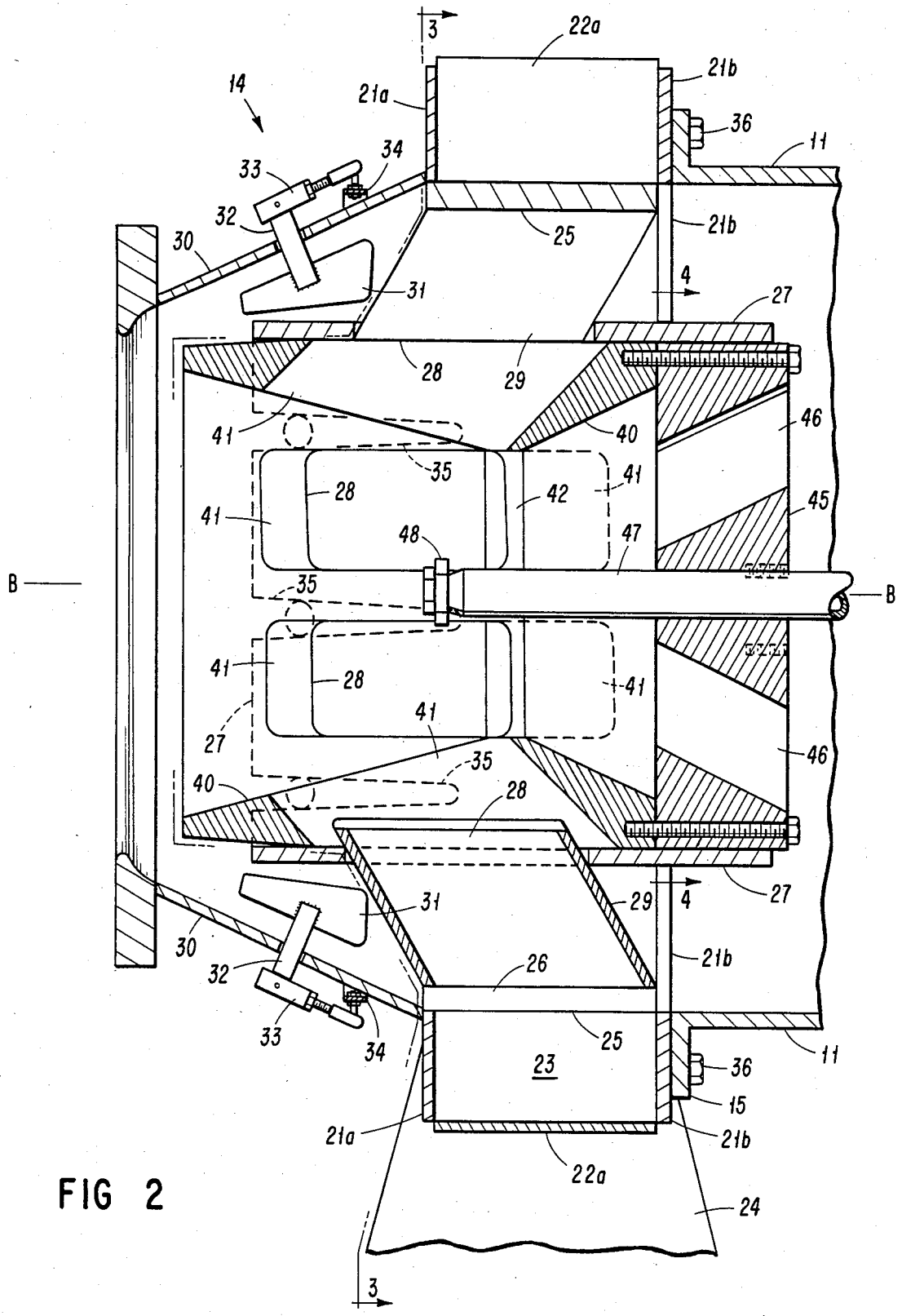
FIG. 2 is a sectional view of the burner head of FIG. 1 taken along the line 2—2 of FIG. 3.

A second annular member in the form of a sleeve 27 concentric with the axis B is spacedly disposed within the annular member 25 (see FIGS. 2 and 3) and is provided with outlets 28 also circularly disposed about the axis B and corresponding to the scroll outlets 26 but offset therefrom both in a clockwise direction about the axis B as viewed in FIG. 3 and in a downstream direction as viewed in FIG. 2. The outlets 26 and 28 are connected by short skewed ducts 29 so that coal and air exiting the outlets 28 are uniformly directed both in a swirl about the axis B and axially downstream. A short-frusto-conical nose 30 is secured to the exterior of the scroll plates 21*a* and fitted with secondary air directing vanes 31. The latter are pivoted on stub shafts 32 through the nose 30 whose outer ends are attached to link arms 33 pivoted in turn to an annular member 34 so that the vanes 31 can be conjointly operated to swirl secondary air either in the same or the opposite direction to that of the coal and air. In order to allow installation and removal of the vanes 31 the downstream end of the sleeve 27 is provided with axially extending slots 35. The adapter is then bolted at 36 to the burner housing flange 15.

Figure 4:
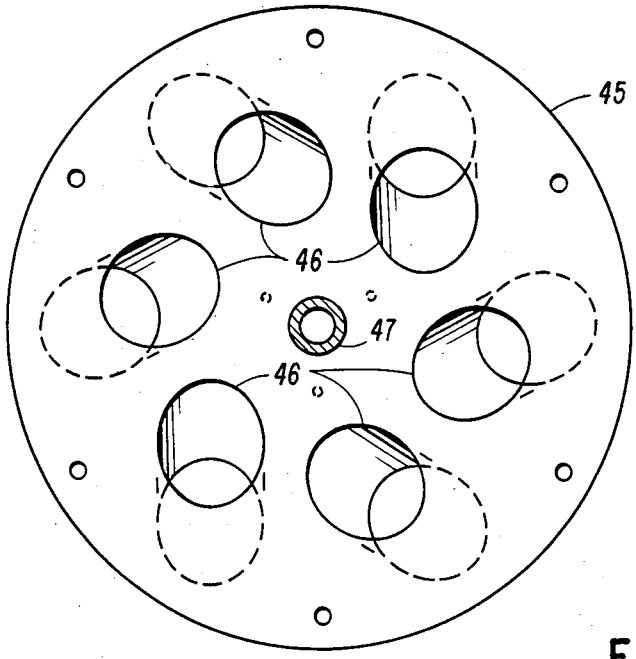
FIG. 4 is a sectional view taken along the line 4—4 of FIG. 2.

The sleeve 27 slidably receives a cylindrical venturi 40 concentric with the axis B but modified to provide coal and air passages 41 exiting just downstream of its throat 42 and forming directional continuations of the outlets 28 and ducts 29. To the upstream end of the venturi 40 and slidable with it is bolted a cylindrical primary air swirler 45 also concentric with the axis B. The swirler 45 is provided with skewed primary air passages 46 (see FIG. 4) to give the primary air the same direction of swirl and axial movement as the coal and air exiting from the venturi passages 41, the venturi 40 and swirler 45 thus constituting a passage for the primary air. The swirler 45 is centrally bored to receive an oil supply pipe 47 fitted with a nozzle 48.

When fired with oil the burner 10 operates in conventional fashion, primary air entering the venturi 40 from the swirler 45 and entraining the oil sprayed from the nozzle 48. Secondary air is supplied through the annular passage between the burner housing 11 and the adapter sleeve 27, passes the ducts 29, is directed by the vanes 31, and is discharged between the downstream ends of the nose 30 and venturi 40 to join the primary air and fuel. As firing rate increased the venturi 40, swirler 45 and oil nozzle 48 slidably retreat upstream within the adapter sleeve 27 in order to meter additional secondary air, this being accomplished by well-known controls associated with the burner 10. One means of moving the venturi 40, swirler 45 and oil nozzle 48 is shown in FIG. 1 of U.S. Pat. No. 4,600,377 to Musil and explained in column 4, lines 41–51 of that patent. When fired with pulverized coal alone or with a combination of coal and oil, LP gas, or natural gas, the coal and it entraining air, which in turn constitutes a portion of the burners's primary air, are introduced into the scroll inlets 24 through conduits 50 from the coal grinding mill (not shown). The coal is supplied to the mill by an auger and the entraining air by a blower or by suction from the atmosphere into the mill, the quantity of coal being metered by a variable speed auger drive motor and the quantity of the air by a damper. The remainder of the primary air from the blower 12 is metered by a set of dampers at the blower intake. The oil metering valve 18, axial movement of the primary air assembly by the shaft 19, the grinding mill air dampers, and the blower intake dampers are all controlled in turn by servo-positioner motors connected together with the auger drive motor into a master control which coordinates the operation of all the former with the fuel or fuels used. Controls of this nature and purpose are known to those in the art so need not be further described.

Accordingly, the incoming coal and air are divided into discrete streams by the internal scroll passages 23 and thus uniformly introduced in a downstream swirl through the circle of venturi passages 41 into the remainder of the primary air emitted from the swirler 45. Note from FIG. 2 that the venturi passages 41 are elongated with respect to the axis B in order to remain aligned with sleeve outlets 28 as firing rate rises and venturi 40 retreats. Hence the pulverized coal does not tend to "bunch up" in the scrolls 20, nor as in prior coal heads, to be injected at just one or two locations into the air stream. Rather it is uniformly distributed around and into the primary air stream where it is better mixed with air for more efficient combustion in the tuyere.

Though the invention has been described in terms of a particular embodiment and in connection with a particular form of oil burner head, being the best mode known of carrying out the invention, its applicability is not limited to that embodiment or burner head alone. The essentials of the adapter, namely, dividing the coal and air into discrete streams and introducing them uniformly about and into the primary air stream, are obviously applicable to burners of other internal structures. Hence, the following claims are to be read as encompassing all adaptations and modifications of the invention falling within its spirit and scope.

I claim:

1. In a burner head means forming a primary air passage in the burner head including a portion of generally circular configuration in cross-section having a plurality of openings uniformally circularly disposed about its periphery, and a manifold effective to envelope said primary air passage means, the manifold having inlet means for connection to a source of pulverized coal and air, a plurality of internal coal and air passages downstream of the inlet effective to divide incoming coal and air into a plurality of discrete streams thereof, and a manifold coal and air outlet opening from each coal and air passage, the manifold outlet openings each being in communication with a duct means having an outlet discharging into one of said openings about the periphery of the primary air passage means.

2. The burner head of claim 1 wherein the manifold includes an integral mirrored pair of scrolls having a central axis, each scroll being symmetrically disposed with respect to a common plane through said central axis and including a coal and air inlet and internal curvilinear coal and air passages effective as aforesaid, the two inlets of the scrolls opening in opposite directions transversely with respect to said central axis, said manifold outlet openings being uniformly circularly disposed about said central axis.

3. The burner head of claim 2 wherein said duct means and said openings about the periphery of the primary air passage means direct coal and air in directions effective to produce both a conjoint swirl of same about said central axis and a conjoint movement of same axially thereof.

4. The burner head of claim 3 including a first annular member co-axial with said central axis and integral with the two scrolls, the two scrolls being disposed on and about the exterior of the first annular member, the first annular member having coal and air outlet openings therethrough forming the downstream ends of the scroll coal and air passages and constituting the upstream ends of said duct means.

5. The burner head of claim 4 wherein the primary air passage means includes an annular venturi member having a throat co-axial with said central axis and disposed within the first annular member, the venturi member having coal and air passages therethrough constituting said openings about the periphery of the primary air passage means and in communication with respective ones of said duct means, the venturi coal and air passages opening into the interior of the venturi member downstream of the throat thereof and forming continuations of said duct means effective to continue said swirl and axial movement of coal and air.

6. The burner head of claim 5 wherein said burner head includes a primary air swirler member co-axial with the venturi member and disposed upstream thereof in the primary air passage means, the swirler member being effective to produce a swirl and axial movement of primary air corresponding to said swirl and axial movement of coal and air.

7. The burner head of claim 6 including means for conjointly moving the venturi and swirler members relative to the manifold along said central axis.

8. The burner head of claim 4 including a second annular member integral with the two scrolls and the first annular member, the second annular member being co-axial with the first annular member and spacedly disposed therewithin, the second annular member having coal and air outlet openings uniformly circularly disposed thereabout corresponding to said openings about the periphery of the primary air passage means, the respective coal and air outlet openings of the first and second annular members being integrally interconnected by said duct means.

9. The burner head of claim 8 wherein said duct means direct coal and air in directions effective to produce said swirl and axial movement of coal and air.

10. The burner head of claim 9 wherein the burner head includes an annular venturi member having a throat co-axial with said central axis and disposed with the second annular member, the venturi member having coal and air passages therethrough constituting said openings about the periphery of the primary air passage means and in communication with respective ones of said outlet openings of the second annular member, the venturi coal and air passages opening into the interior of the venturi member downstream of the throat thereof and forming continuations of said duct means effective to continue said swirl and axial movement of coal and air.

11. The burner head of claim 10 wherein said burner head includes a primary air swirler member co-axial with the venturi member and disposed upstream thereof in the primary air passage means, the swirler member being effective to produce a swirl and axial movement of primary air corresponding to said swirl and axial movement of coal and air.

12. The burner head of claim 11 including means for conjointly moving the venturi and swirler members relative to the second annular member along said central axis.

* * * * *